US006346782B1

(12) United States Patent
Knoble

(10) Patent No.: US 6,346,782 B1
(45) Date of Patent: Feb. 12, 2002

(54) MULTIPLE LAMP BALLAST SYSTEM

(75) Inventor: David W. Knoble, Tupelo, MI (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 09/752,480

(22) Filed: Jan. 2, 2001

Related U.S. Application Data

(63) Continuation-in-part of application No. 09/317,831, filed on May 25, 1999.

(51) Int. Cl.[7] ..... H05B 37/00

(52) U.S. Cl. ..... 315/312; 315/323; 315/324; 315/137; 315/146

(58) Field of Search ..... 315/312, 56, 137, 315/139, 146, 178, 189, 191, 192, 194, 195, 209 R, 210, 246, 250, 251, 323, 324; 362/222, 227

(56) References Cited

U.S. PATENT DOCUMENTS 4,468,725 A * 8/1984 Venturini ..... 363/160
RE33,057 E * 9/1989 Clegg et al. ..... 315/224
5,325,024 A * 6/1994 Piejak et al. ..... 315/248
5,479,327 A * 12/1995 Chen ..... 362/222
5,867,358 A * 2/1999 Campbell ..... 361/47
5,907,218 A * 5/1999 Altman ..... 315/56
6,023,131 A * 2/2000 Okita ..... 315/291
6,079,851 A * 6/2000 Altman et al. ..... 362/260
6,181,066 B1 * 1/2001 Adamson ..... 315/2.28

* cited by examiner

*Primary Examiner*—Don Wong
*Assistant Examiner*—Tuyet T. Vo
(74) *Attorney, Agent, or Firm*—Jeffrey A. Haeberlin; Middleton Reutlinger

(57) ABSTRACT

A multiple lamp instant start ballast system has multiple fluorescent lamps and a ballast. The lamps have substantially similar current characteristics. The ballast has a ballast circuit operable to supply instant start starting voltages and operating currents, with the voltages and currents being approximately equal in magnitude and differing in phase by 360°/n, where n is the number of lamps. By connecting the ballast output leads to the first end of each lamp, the second ends of the lamps may be connected together creating a balanced n-phase system. Thus, wiring between the ballast and the second ends of the lamps is unnecessary. An improved light fixture adds a chassis and lamp sockets to the multiple lamp instant start ballast system described. The standard wire-way and wire-way cover are obviated since no wiring need be run to the second ends of the lamps. Wiring may be reduced by locating the ballast adjacent to the lamp first ends. Additional benefits are achieved by orienting the lamps in parallel to one another such that their first ends are adjacent to one another.

12 Claims, 3 Drawing Sheets

MULTIPLE LAMP BALLAST SYSTEM

CROSS-REFERENCE TO RELATED APPLICATIONS

This Application is a Continuation-in-Part of U.S. patent application Ser. No. 09/317,831 filed May 25, 1999.

BACKGROUND OF THE INVENTION

1. Field of the Invention

The present invention relates to light fixtures, and in particular to a multiple lamp ballast system for fluorescent light fixtures having instant start type tubes.

2. Description of Prior Art

Instant start fluorescent lamps depend on the application of a high voltage across the lamp electrodes to initiate the lamp arc and operation of the lamp. This voltage ejects electrons from the electrodes by field emission. These electrons flow through the tube, ionizing the gas and initiating an arc discharge. Thereafter, the arc current provides electrode heating. Instant start lamps, therefore, need only a single contact at each end of the tube, which reduces the wiring necessary to operate the lamps.

FIG. 1 shows a typical two lamp instant start type fixture in which two lamps 10, 12 are oriented in parallel to one another. Sockets 18, 20, 26, 28 provide mechanical support and electrical contact to the lamps 10, 12. A ballast 14 has three output leads 16, 22, 24. A first ballast lead 16 is connected to each of two sockets 18, 20 on one side of the lamps. Second and third leads 22, 24 are connected to sockets 26, 28 at the opposite ends of the lamps, respectively.

FIG. 2 shows a typical three lamp instant start type fixture in which three lamps 30, 32, 34 are also arranged (physically) parallel to one another. Sockets 36, 38, 40, 52, 54, 56 provide mechanical support and electrical contact to the lamps 30, 32, 34. A ballast 44 has four leads 42, 46, 48, 50. A first ballast lead 42 is connected to each of three sockets 36, 38, 40 on one side of the lamps. Second, third and fourth leads 46, 48, 50 are connected to sockets 52, 54, 56 at the opposite ends of the lamps, respectively.

Both configurations described above require that wiring be run from the ballast to each side of the lamps, thus requiring a wire-way and wire-way cover as a part of the fixture. Multiple lamp fixtures are high volume items in the market place, and it is desirable to reduce the cost of manufacturing these fixtures by eliminating wiring, wire-way and wire-way cover materials.

SUMMARY OF THE INVENTION

It is an object o f the present invention to provide a multiple lamp instant start type fluorescent light fixture having minimal wiring and eliminating the need for providing a wire-way and wire-way cover.

It is a further object of the invention to provide a multiple lamp ballast system for tubular instant start fluorescent lamps in which the ballast is wired to one end of the lamps only.

The present invention provides a multiple lamp ballast system having a plurality of instant start type flourescent lamps having substantially the same current characteristics, and a ballast. Each of the lamps is tubular in shape, having a first end and a second end. The ballast has at least one power input lead electrically connected to the ballast circuit, and a plurality of power output leads, also electrically connected to the ballast circuit, corresponding to the number of lamps of the fixture. Each power output lead corresponds to a different lamp. The ballast circuit is operable to supply the voltages and currents required to start and operate the instant start type lamps. The ballast circuit is designed such that the starting voltages and operating currents supplied to each output lead are approximately equal in magnitude and differing in phase by 360°/n, where n is the number of power output leads being supplied. A first plurality of electrical contacts serve to connect each output lead to a different lamp first end. A second plurality of electrical contacts serve to connect the second ends of each lamp together. Thus, a balanced n-phase system is created and it is unnecessary to run any wiring between the ballast and the second ends of the lamps.

By orienting the lamps such that the first ends are adjacent to one another, the lengths of the first plurality of electrical contacts may be minimized. By physically locating the ballast adjacent to the lamp first ends the electrical contact materials may be even further reduced.

Additional manufacturing and performance benefits may be achieved by orienting the lamps in parallel to one another such that the first ends are adjacent to one another. Electrical contact materials may also be reduced in this arrangement by physically locating the ballast adjacent to the lamp first ends than to the second ends.

Further, an improved light fixture may be achieved by utilizing the ballast system of the invention in conjunction with lamp sockets and a fixture chassis. The lamps have first and go second ends, with each end having a base pin. The lamp sockets are mounted to the chassis and have electrical contact blades therein. The lamp sockets mechanically support and electrically power, via the contact blades, the lamps. The ballast operates as previously described, with the power output leads electrically connecting the ballast circuit to the lamp first end socket blades. An electrical connector connects the lamp second end socket blades together. Once again, the resulting balanced n-phase system eliminates the need to connect the lamp second ends to the ballast.

DETAILED DESCRIPTION OF THE PREFERRED EMBODIMENT

Figure 1:
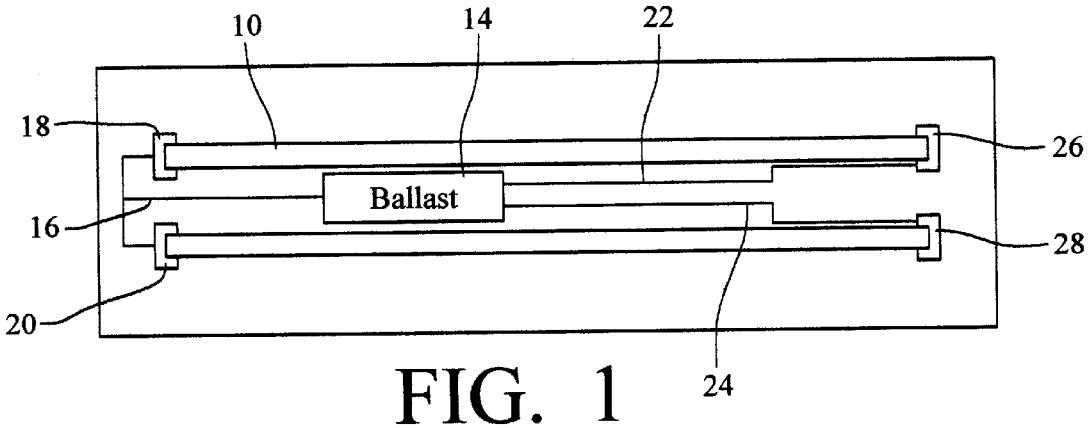
FIG. 1 PRIOR ART
FIG. 1 shows a two lamp instant start ballast fixture as is known in the prior art.
Figure 2:
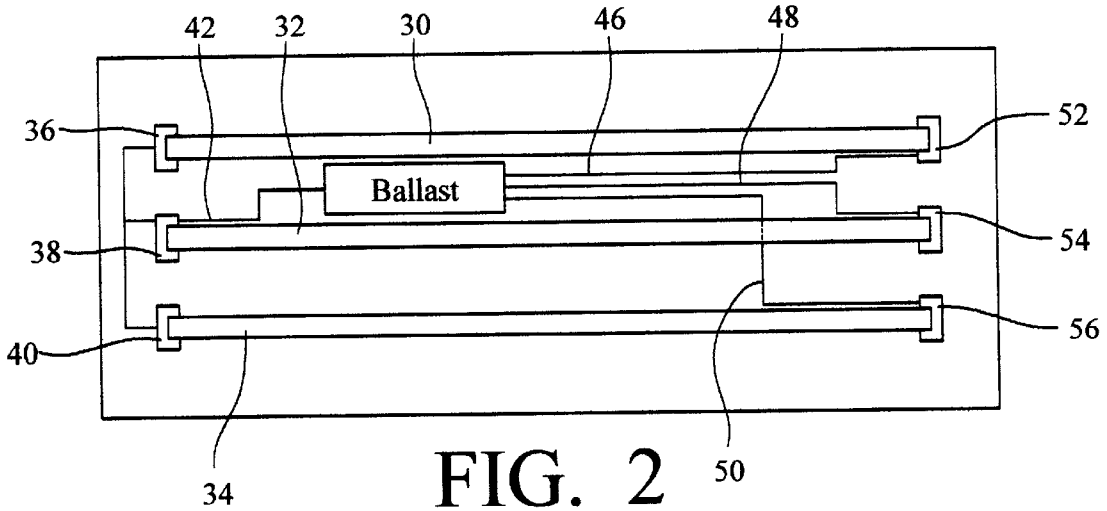
FIG. 2 PRIOR ART
FIG. 2 shows a three lamp instant start ballast fixture as is known in the prior art.
Figure 3:
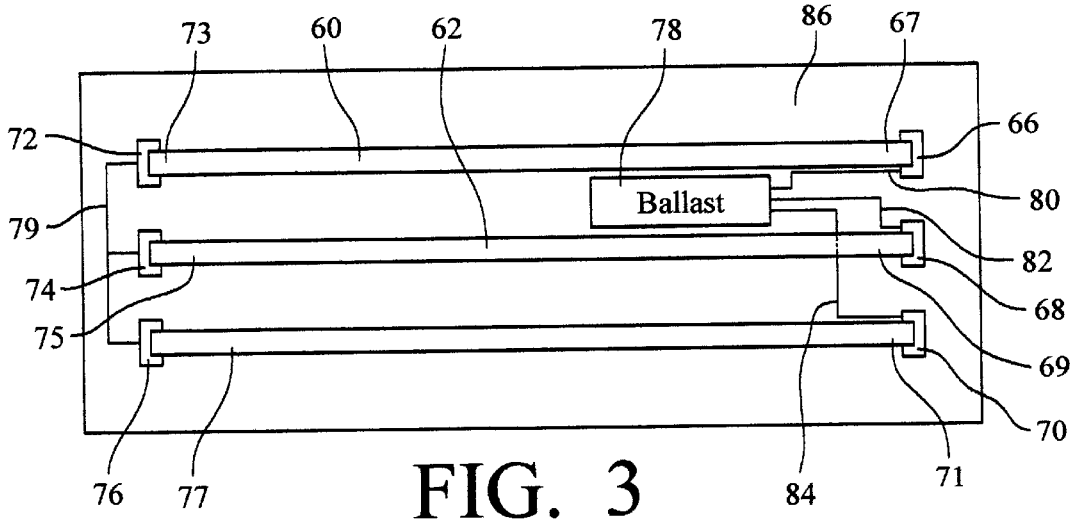
FIG. 3 is a bottom view with circuit elements of a ceiling mounted light fixture of the preferred embodiment of the present invention.
Figure 4:
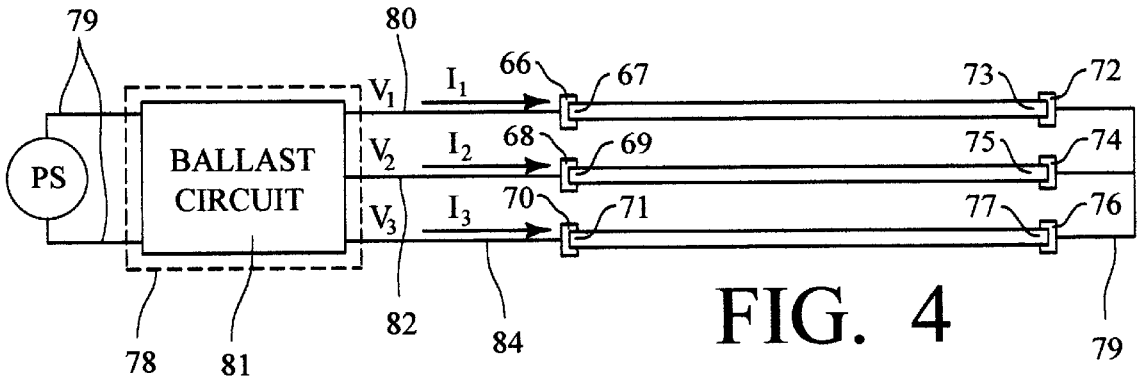
FIG. 4 is a circuit diagram of the device of FIG. 3.

A preferred embodiment of the multiple lamp instant start ballast system of the present invention having three lamps is shown in FIGS. 3 and 4. It should be understood that the teachings of the present invention will apply to multiple lamp ballast system with any plurality of lamps.

Three lamps 60, 62, 64 having substantially the same current characteristics are physically oriented in parallel and have first ends 67, 69, 71 and second ends 73, 75, 77.

Figure 5:
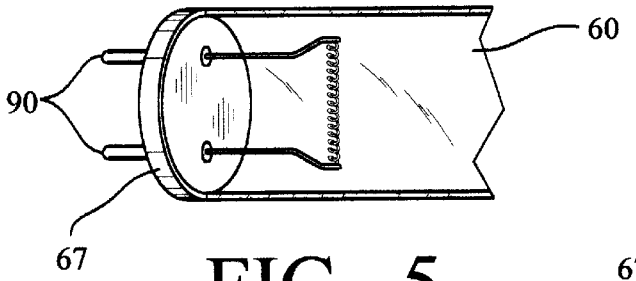
FIG. 5 is a partial perspective view with selected portions cut away of a bi-pin base instant start tubular fluorescent lamp.
Figure 5A:
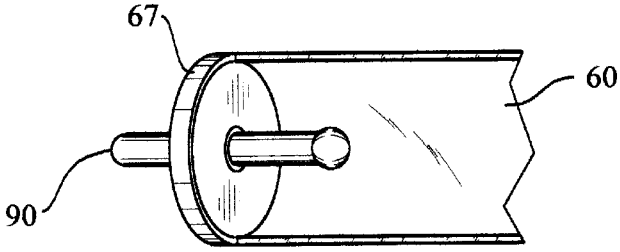
FIG. 5*a* is a partial perspective view with selected portions cut away of a single pin base instant start fluorescent lamp.

As shown in FIGS. 5 and 5*a*, each lamp end has at least one base pin 90. Straight tube lamps designed for instant start operation only require a single base pin at each end, as shown in FIG. 5*a*. These lamps are commonly called slim-line lamps. As shown in FIG. 5, some instant start type lamps use bi-pin bases. Instant start type lamps utilizing bi-pin bases usually operate with both pins connected to the same ballast lead, usually through a jumper in the lamp socket.

As shown in FIG. 3, lamp sockets 66, 68, 70, 72, 74, 76, corresponding to each lamp end, are mounted to a chassis 86 and provide mechanical support and electrical power to the lamps 60, 62, 64.

Figure 6:
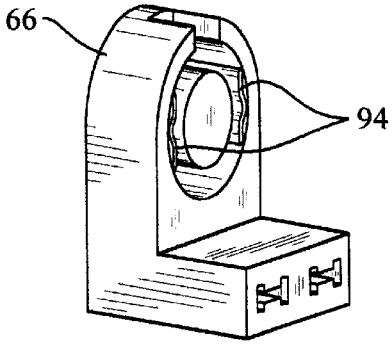
FIG. 6 is a perspective view of a lamp socket for a bi-pin base instant start fluorescent lamp.
Figure 6A:
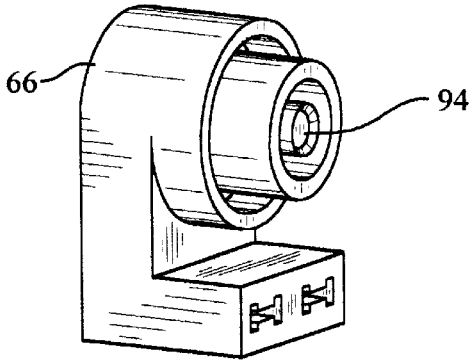
FIG. 6*a* is a perspective view of a lamp socket for a single pin base instant start fluorescent lamp.

As shown in FIGS. 6 and 6*a*, each lamp socket 66 has at least one electrical contact blade 94 for contacting the base pin(s) 90 on a fluorescent lamp 60.

As shown in FIG. 3, a ballast 78 is also mounted to the chassis 86.

As best shown in FIG. 4, the ballast 78 has at least one input lead 79 for receiving power from a power source. A ballast circuit 81 is electrically connected to the input lead 79 and output leads 80, 82, 84. The output leads 80, 82, 84 are also electrically connected to the contact blade(s) in the first end lamp sockets 66, 68, 70, which, in turn, are in electrical contact with the base pins in the lamp first ends 67, 69, 71. The base pins in the lamp second ends 73, 75, 77 are in electrical contact with the contact blade(s) in the second end lamp sockets 72, 74, 76. An electrical connector 79 connects the second end socket contact blades together.

The ballast circuit 81 is designed to provide starting voltages and operating currents to the lamps 60, 62, 64 with the starting voltages and currents to each lamp being approximately equal in magnitude and differing in phase by, in the three lamp embodiment, 120°. Thus, a balanced three-phase system is created eliminating the need to run any wiring between the ballast and the second ends of the lamps. As shown graphically in FIG. 7, phasor diagrams show that the sum of the voltages, and currents by a similar graphic construction, in the electrical connector 79 is zero. Thus, eliminating the need to connect the lamp second ends to anything other than each other.

Figure 7:
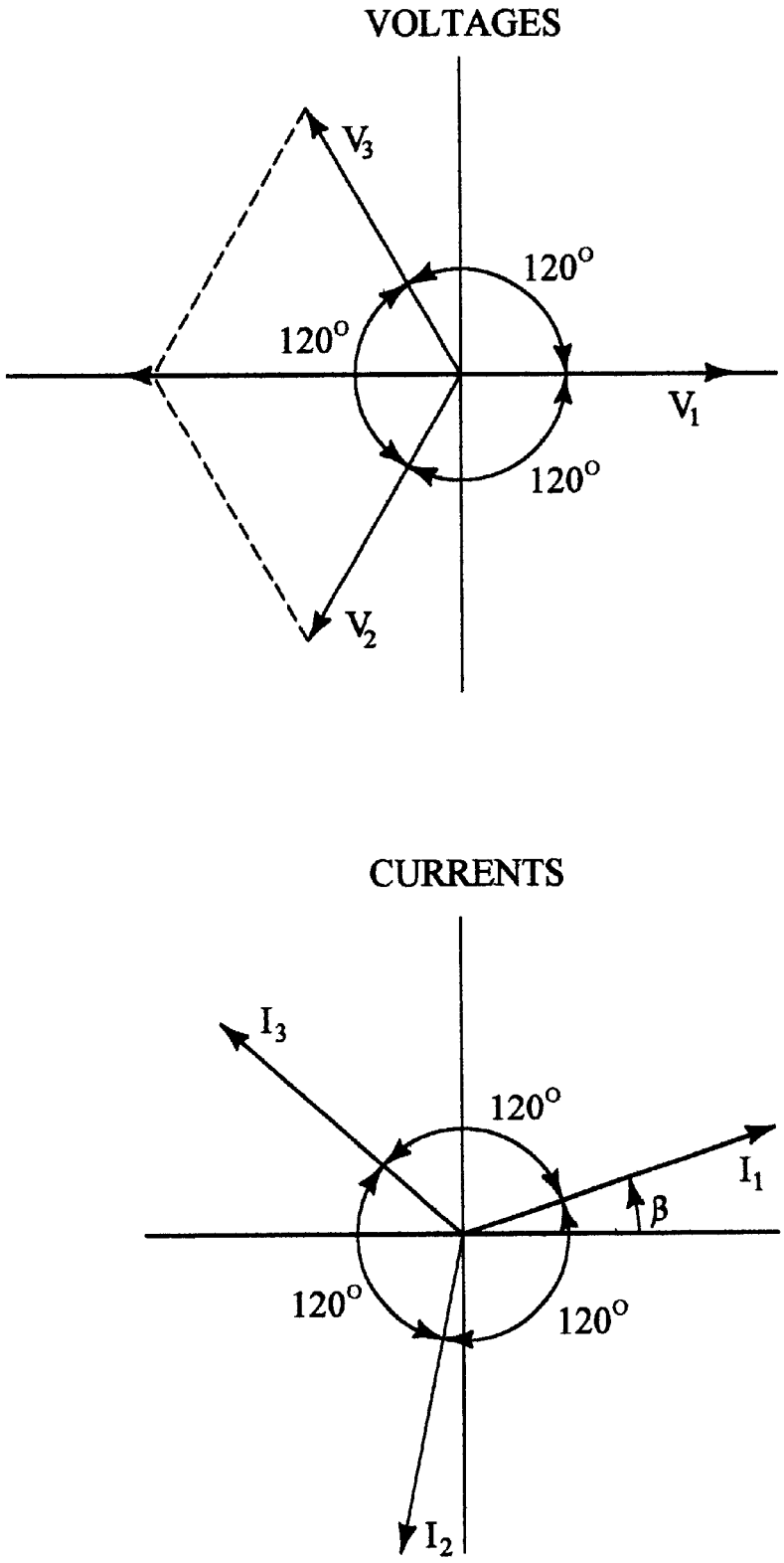
FIG. 7 shows phasor diagrams for the voltages and currents at a common point in the preferred embodiment of the present invention.

As shown in FIG. 7, voltages $V_1$, $V_2$ and $V_3$ are the voltages at the ballast power output leads 80, 82, 84. For convenience, $V_1$ is chosen as the reference voltage. When added together, the voltages the sum of the voltages is zero. With respect to the currents, the value of angle $\beta$ will depend on the load, however, the sum of the currents is also zero.

By analogy, the ballast system described herein may be expanded to operate with multiple lamps of any plurality by utilizing a ballast circuit supplying starting voltages and operating currents to the lamps, with the voltages and currents being approximately equal in magnitude and differing in phase by 360°/n, where n is the number of lamps.

Thus, material savings may be realized in manufacturing of light fixtures utilizing such a ballast system, since wiring from the ballast to the second end of the lamps is unnecessary, as is the corresponding need for a wire-way and wire-way cover for such wiring. Further material savings may be realized by orienting the lamps in parallel with the first ends adjacent to one another and the ballast adjacent to the lamp first ends, as depicted in the preferred embodiment description herein.

This detailed description is given primarily for clearness of understanding and no unnecessary limitations are to be understood therefrom for modifications will become obvious to those skilled in the art upon reading this disclosure and may be made without departing from the spirit of the present invention and scope of the appended claims.

What is claimed is:

1. A multiple lamp ballast system comprising:

a plurality of tubular fluorescent lamps having substantially the same current characteristics, each lamp having a first end and a second end;

a ballast having:

a power input lead;

a ballast circuit electrically connected to said power input lead;

a plurality of power output leads corresponding to the number of said tubular fluorescent lamps, said power output leads electrically connected to said ballast circuit;

said ballast circuit operable to supply instant start lamp starting voltages and operating currents to said power output leads, said voltages and currents being approximately equal in magnitude and differing in phase by 360°/n wherein n is the number of power output leads being supplied;

a first plurality of electrical contacts, each of said first contacts electrically connecting one of said power output leads to a different tubular fluorescent lamp first end, such that each power output lead is electrically connected to a separate fluorescent lamp; and a second plurality of electrical contacts electrically connecting each of said tubular fluorescent lamps second ends together, there being no wiring between said ballast and said tubular fluorescent lamp second ends.

2. The multiple lamp ballast system of claim 1 wherein said lamps are oriented such that said first ends are substantially adjacent to one another.

3. The multiple lamp ballast system of claim 2 wherein said ballast is located adjacent said lamp first ends.

4. The multiple lamp ballast system of claim 1 wherein said lamps are oriented substantially in parallel to one another such that said first ends are substantially adjacent to one another.

5. The multiple lamp ballast system of claim 4 wherein said ballast is located adjacent said lamp first ends.

6. A fluorescent light fixture having instant start type lamps comprising:

a plurality of instant start type tubular fluorescent lamps having substantially the same current characteristics, each lamp having a first end and a second end, each end having at least one base pin;

a plurality of lamp sockets corresponding to each lamp end, each lamp socket having a contact blade, said contact blades being in electrical contact with said lamp base pin of said corresponding lamp end;

a chassis, said lamp sockets mounted to said chassis, said lamp sockets in mechanical support contact with said lamp ends, said socket blades in electrical contact with said lamp base pins;

a ballast mounted to said chassis, said ballast having:

a power input lead;

a ballast circuit electrically connected to said power input lead; and a plurality of power output leads corresponding to the total number of said tubular fluorescent lamps, each said power output lead electrically connecting said ballast circuit to a different lamp first end socket blade;

said ballast circuit operable to supply instant start lamp starting voltages and operating currents to said power output leads, said voltages and currents being approximately equal in magnitude and differing in phase by 360°/n wherein n is the number of power output leads being supplied; and an electrical connector connecting said lamp second end socket blades together, there being no wiring between said ballast and said lamp second end socket blades.

7. The light fixture of claim 6 wherein said lamps are oriented such that said first ends are substantially adjacent to one another.

8. The light fixture of claim 7 wherein said ballast is located adjacent said lamp first ends.

9. The light fixture of claim 6 wherein said chassis is elongated, said chassis having a first end and a second opposite end, said lamp sockets mounted adjacent each end of said chassis such that said lamps are oriented substantially in parallel to one another such that said first ends are substantially adjacent to one another.

10. The light fixture of claim 9 wherein said ballast is located adjacent said lamp first ends.

11. A multiple lamp instant start ballast system comprising:

at last three tubular fluorescent lamps, each of said at least three fluorescent lamps having a first end and a second end;

an instant start lamp ballast having an input lead and a predefined number of output leads, said predefined number of output leads matching said number of tubular fluorescent lamps, each of said output leads individually electrically connected to one of said fluorescent lamps at said first end;

wherein said instant start ballast supplies an instant start operating voltage and current of about equal in magnitude and differing in phase by about 360 divided by the total number of said at least three tubular fluorescent lamps;

and wherein said output leads of said at least three tubular fluorescent lamps are electrically connected together.

12. A multiple lamp instant start ballast system, comprising:

a first, second and third instant start type tubular fluorescent lamp, each of said fluorescent lamps having a first end and a second end and having an electrical contact on each of said first and said second end;

an instant start lamp ballast circuit having an input lead and three output leads, each of said output leads individually electrically connected to one of said fluorescent lamps at said first end;

an output lead connector;

wherein said instant start ballast circuit supplies an instant start operating voltage and current of about equal in magnitude and differing in phase by about 120 degrees;

and wherein said output lead connector electrically connects output leads of said three tubular fluorescent lamps together.

* * * * *